US011079083B1

(12) United States Patent
Yang

(10) Patent No.: US 11,079,083 B1
(45) Date of Patent: Aug. 3, 2021

(54) ROTATING LIGHTING DECORATION

(71) Applicant: Chin-Sheng Yang, Tainan (TW)

(72) Inventor: Chin-Sheng Yang, Tainan (TW)

( * ) Notice: Subject to any disclaimer, the term of this patent is extended or adjusted under 35 U.S.C. 154(b) by 0 days.

(21) Appl. No.: 17/009,732

(22) Filed: Sep. 1, 2020

(51) Int. Cl.

| | |
|---|---|
| ***F21S 10/00*** | (2006.01) |
| ***F21V 3/06*** | (2018.01) |
| ***G09F 13/34*** | (2006.01) |
| ***G09F 19/02*** | (2006.01) |
| ***F21Y 115/10*** | (2016.01) |

(52) U.S. Cl.
CPC ..... *F21S 10/002* (2013.01); *F21V 3/06* (2018.02); *G09F 13/34* (2013.01); *G09F 19/02* (2013.01); *F21Y 2115/10* (2016.08)

(58) Field of Classification Search
CPC ..... F21S 10/002; G09F 19/02; G09F 13/34; F21V 3/06; F21Y 2115/10; F21W 2131/30; A47G 2019/2238
See application file for complete search history.

(56) References Cited

U.S. PATENT DOCUMENTS

| | | | | |
|---|---|---|---|---|
| 4,852,283 | A * | 8/1989 | Teng | A63H 13/04 40/426 |
| 6,508,022 | B2 * | 1/2003 | Huang | G09F 19/08 40/406 |
| 10,825,366 | B1 * | 11/2020 | Yang | F16H 1/20 |
| 2011/0119971 | A1 * | 5/2011 | Chen | G09F 19/02 40/406 |

* cited by examiner

*Primary Examiner* — Peggy A Neils
(74) *Attorney, Agent, or Firm* — Leong C. Lei

(57) ABSTRACT

A rotating lighting decoration includes an aqueous sphere, a magnetic moving member, a fixed decoration piece, a suspending decoration piece, and a base. The magnetic moving member, the fixed decoration piece, and the suspending decoration piece are arranged in the aqueous sphere. The aqueous sphere is filled with a flowable liquid. The fixed decoration piece is fixed to a bottom of the aqueous sphere and located at a periphery of the magnetic moving member. The suspending decoration piece is arranged at a periphery of the fixed decoration piece. The base is mounted to the bottom of the aqueous sphere and includes a magnetic rotary axle that magnetically attracts the magnetic moving member. When rotating, the magnetic rotary axle drives the magnetic moving member to rotate and thus disturb the liquid inside the aqueous sphere to flow and drive the suspending decoration piece to rotate relative to the fixed decoration piece.

8 Claims, 9 Drawing Sheets

ROTATING LIGHTING DECORATION

TECHNICAL FIELD OF THE INVENTION

The present invention relates to a lighting decoration, and more particularly to a lighting decoration that uses liquid contained in an interior thereof to cause decoration pieces to generate a visual effect of rotating in a suspended condition.

DESCRIPTION OF THE PRIOR ART

In daily living, decorations that are commonly placed on for example a desk generally include photo frames and decoration toys. Such decorations that are involved for aesthetics of observation are generally static articles. Heretofore, an aqueous lamp that contains for example sequins and glitter particles or decorating pieces in an interior thereof is available, which generates a visual effect resulting from movement of the sequins, glitter particles, or decorating pieces caused by being inverted and shaken manually or by power, and different visual effects may be caused according to different objects contained in the lamp, so that flexibility of expansion of application may be realized to various visual variability or multiplicity of functionality and interesting. The present inventor has previously proposed a variety of devices that are made to overcome certain drawbacks of the known devices, and numerous patents have been granted for such devices, including U.S. Pat. Nos. 8,960,938 and 8,695,247.

Further research and study have been taken to provide further improvement of standing decorations. One of such improvements includes a decoration article that, in addition to being made for visual aesthetics, involves a dynamic effect of rotation for the purposes of expanding the effect of aesthetics and interesting. The present invention aims to provide one such improvement.

SUMMARY OF THE INVENTION

In view of the above, the primary objective of the present invention is to provide a rotating lighting decoration, which comprises:

an aqueous sphere, which is of a light-transmitting three-dimensional configuration and includes a hollow shell and a bottom lid, the shell being formed with an opening facing down, the bottom lid being set on and closing the opening of the shell so as to define a closed space in an interior of the shell, the closed space being filled with a flowable liquid;

a magnetic moving member, which is arranged in the closed space and is located at a bottom of the aqueous sphere;

a fixed decoration piece, which is arranged in the closed space and disposed on the bottom lid and has a predetermined shape, the fixed decoration piece having a bottom that is provided with a positioning seat, by which the magnetic moving member is constrained to rotate in a given range;

a suspending decoration piece, which includes a bottom plate and a first decoration plate, the bottom plate being formed, in an axial direction, with a through hole, the through hole having a circumference that is provided with a plurality of rotating parts spaced from each other, the first decoration plate including two shaped braces that are symmetric, the two shaped braces being connected to each other at one end and each having an opposite end disposed on the bottom plate, the suspending decoration piece being supported by the liquid, so as to have a top thereof abutting the shell and a bottom set in a suspending condition to define a distance from the bottom lid; and a base, which is connected to the bottom of the aqueous sphere, the base including an electric control unit, the electric control unit comprising at least one light-emitting element, the light-emitting element being electrically connected with the electric control unit, the light-emitting element being operable to illuminate in a direction toward the aqueous sphere, the base including a magnetic rotary axle that corresponds to and attracts the magnetic moving member, the magnetic rotary axle being drivable by a power member to rotate;

wherein when the magnetic rotary axle is rotating, the magnetic moving member is attracted thereby to rotate in unison therewith to disturb and drive the liquid to flow in the interior, so as to cause the suspending decoration piece to move with the flow of the liquid for rotating relative to the fixed decoration piece, and thus provide and enhance an effect of dynamic visual perception.

DETAILED DESCRIPTION OF THE PREFERRED EMBODIMENT

Figure 1:
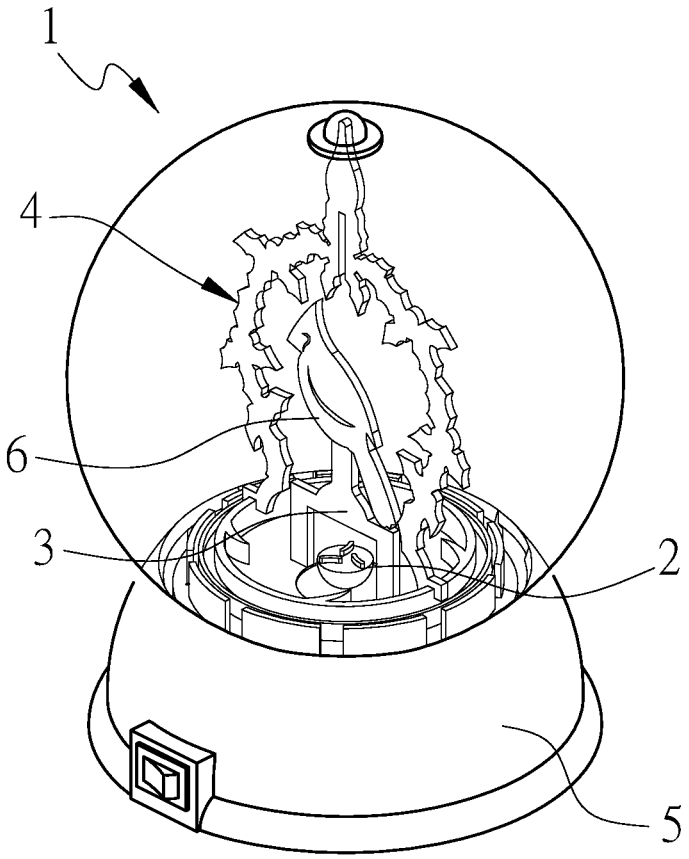
FIG. 1 is a perspective view of the present invention.
Figure 2:
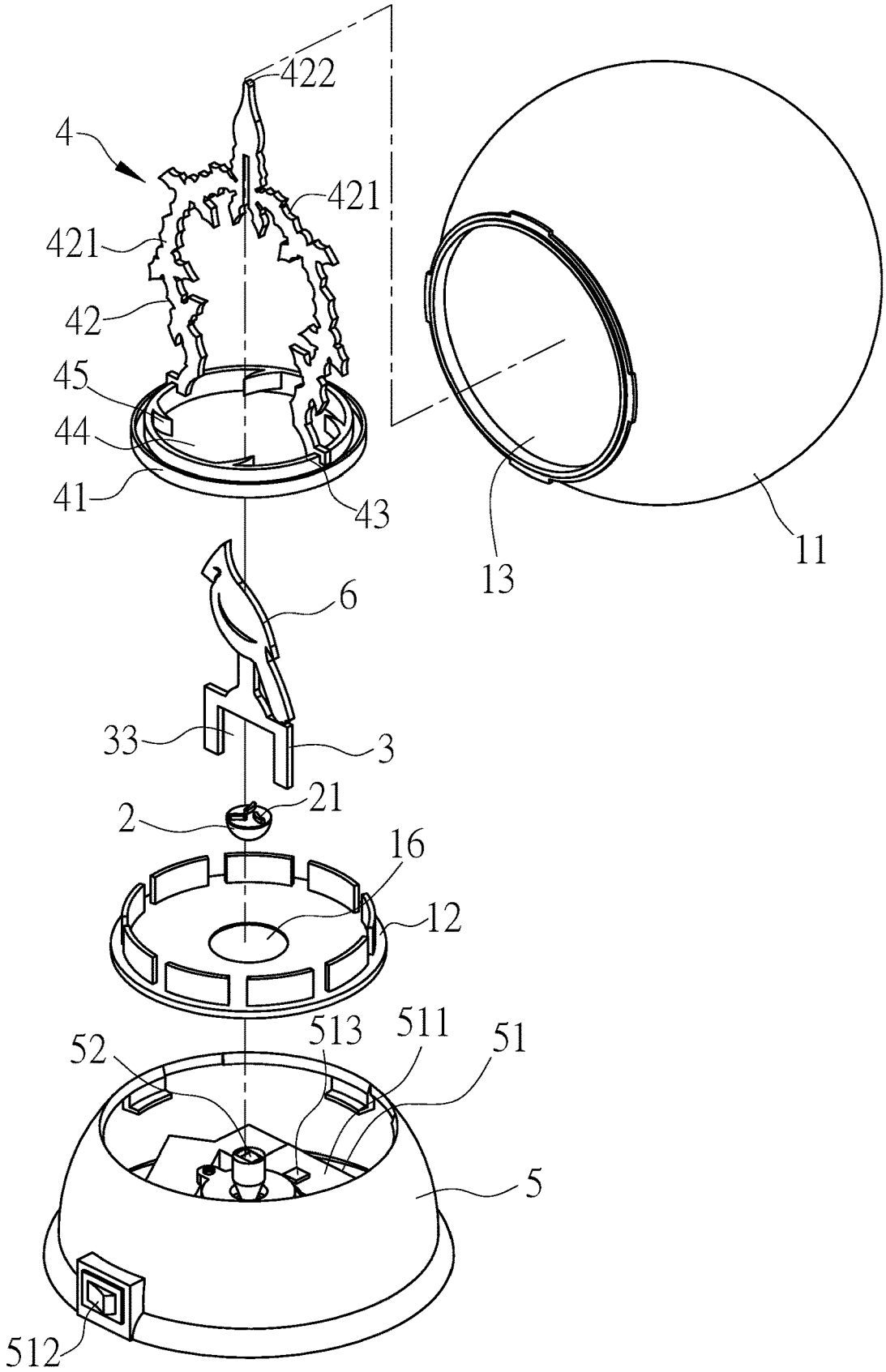
FIG. 2 is an exploded view of the present invention.
Figure 3:
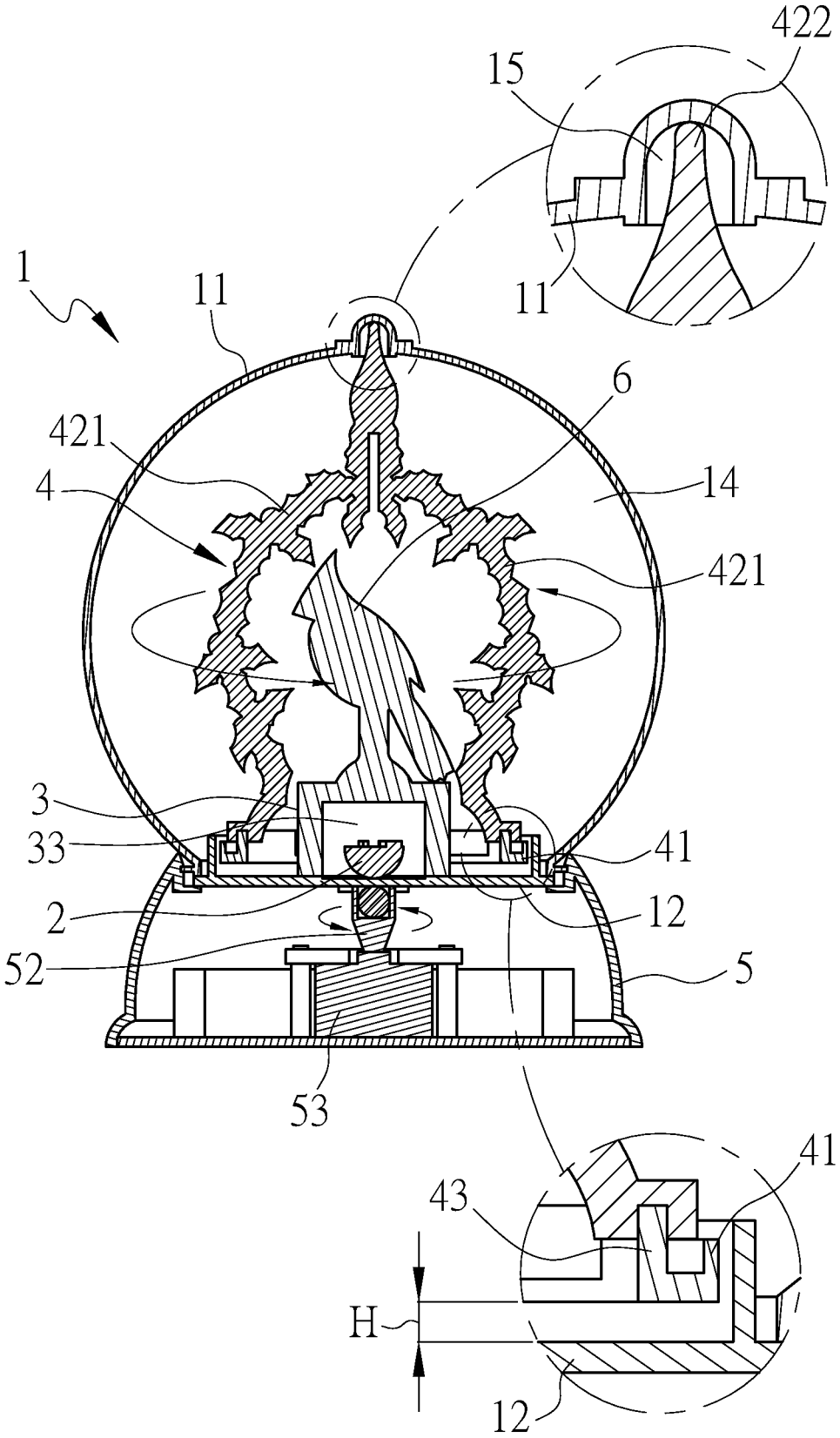
FIG. 3 is a cross-sectional view of the present invention, in which additional views are included in an enlarged form to illustrate circled portions thereof.
Figure 4:
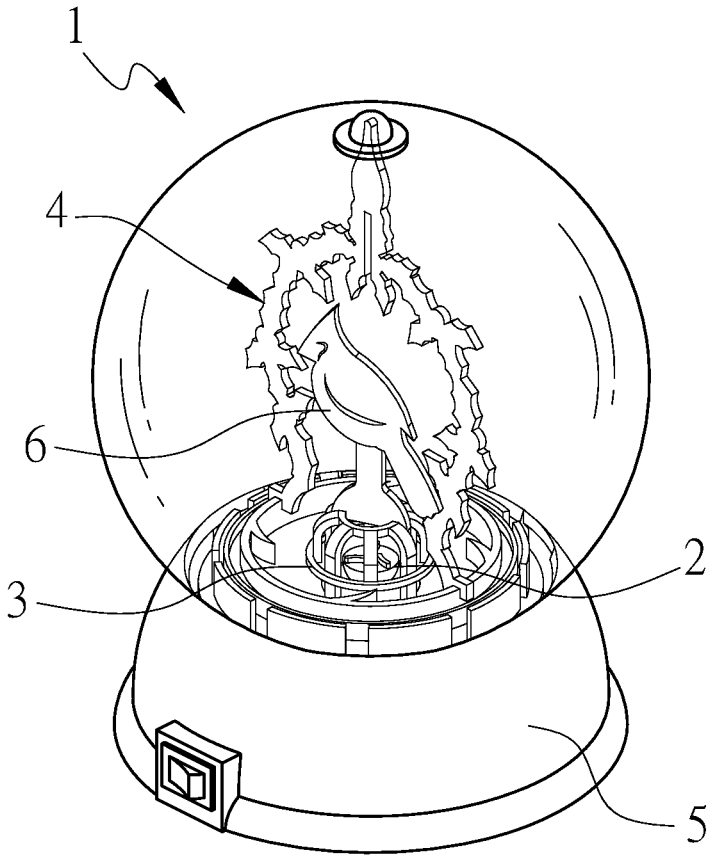
FIG. 4 is a perspective view illustrating a different embodiment according to the present invention.
Figure 5:
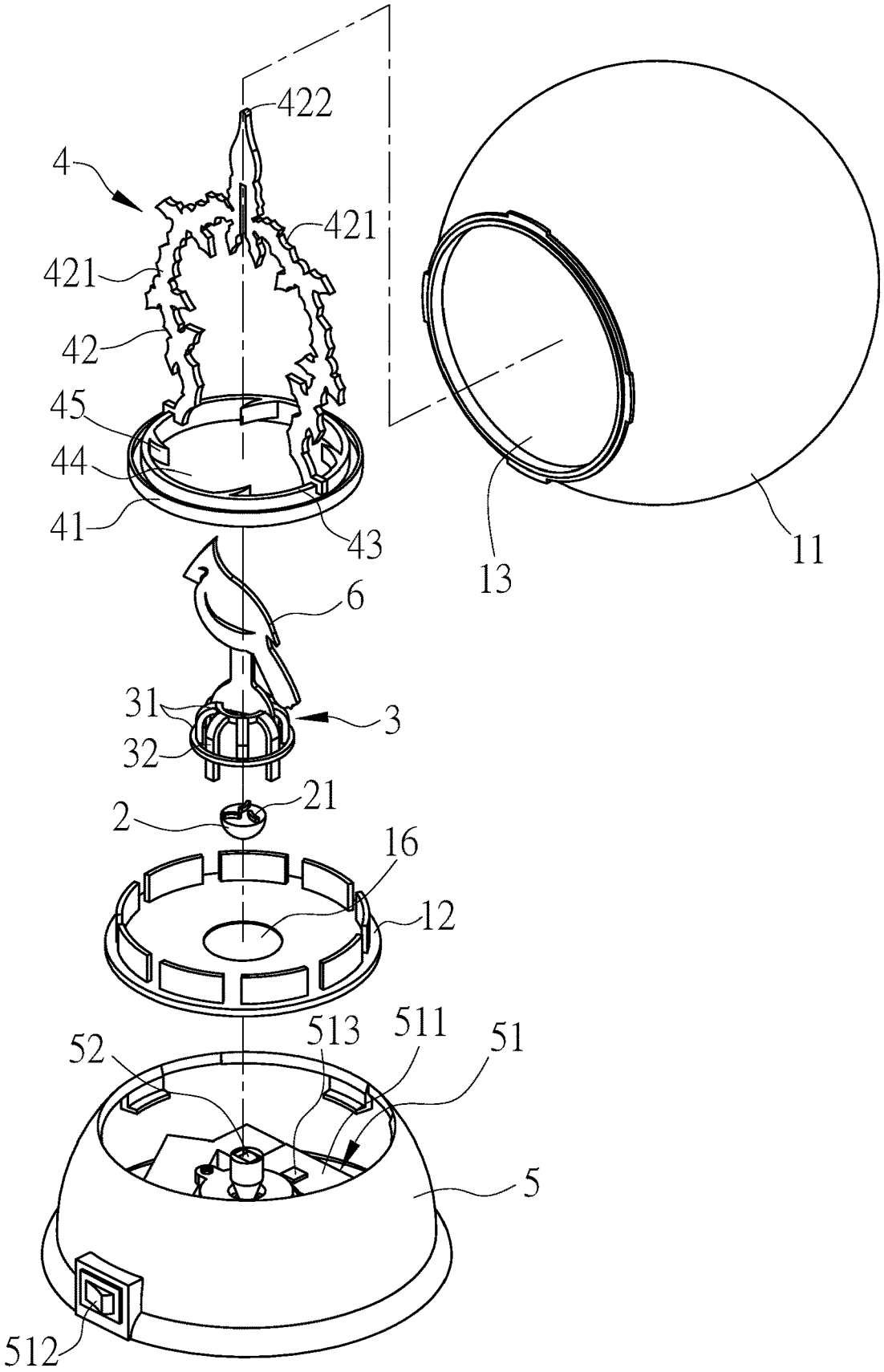
FIG. 5 is an exploded view illustrating said different embodiment according to the present invention.
Figure 6:
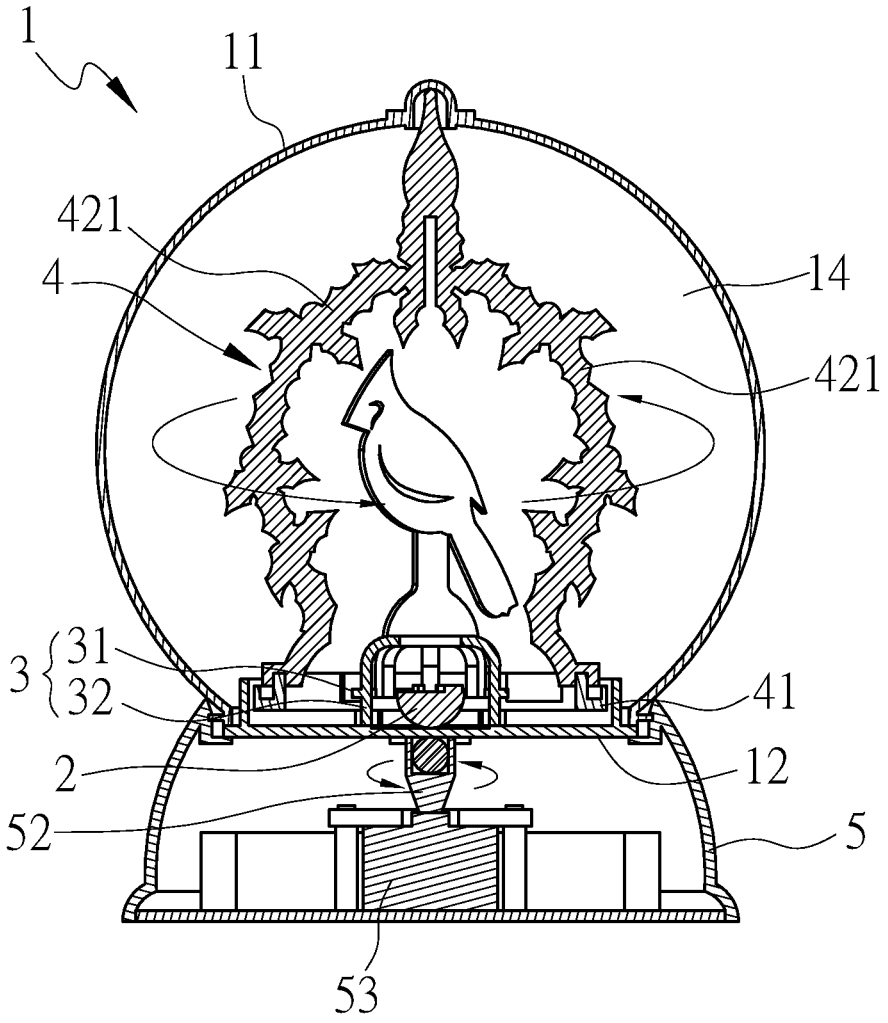
FIG. 6 is a cross-sectional view illustrating said different embodiment according to the present invention.
Figure 7:
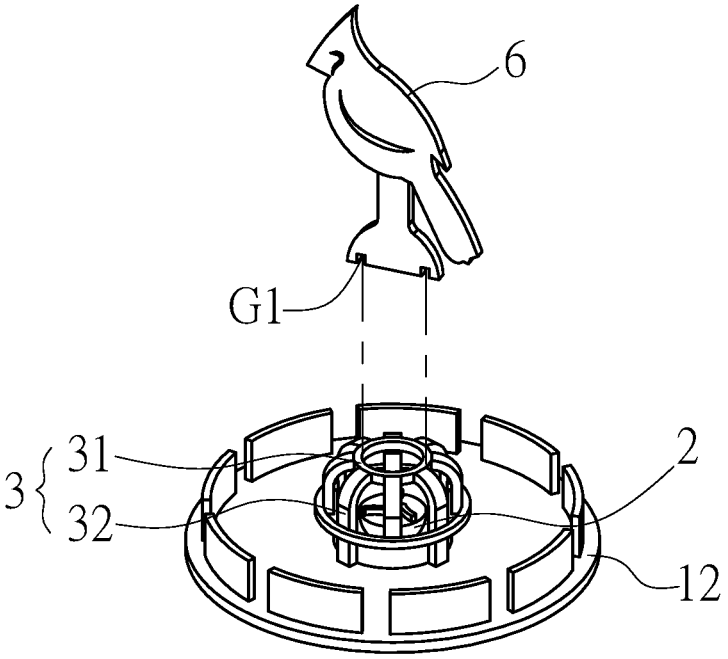
FIG. 7 is a schematic view illustrating assembling of a fixed decoration piece and a positioning seat according to the present invention.

Referring to FIGS. 1-3, a rotating lighting decoration according to a preferred embodiment of the present invention is shown, mainly comprising: an aqueous sphere (1), a magnetic moving member (2), a fixed decoration piece (6), a suspending decoration piece (4), and a bottom base (5), wherein the magnetic moving member (2), the fixed decoration piece (6), and the suspending decoration piece (4) are arranged in an interior of the aqueous sphere (1), and the base (5) is connected to a bottom of the aqueous sphere (1).

The aqueous sphere (1) is a light-transmitting three-dimensional configuration, of which an example illustrated in the drawings is a spherical shape, but not limited thereto. The aqueous sphere (1) includes a hollow shell (11) and a bottom lid (12). The shell (11) includes an opening (13) facing downward. The bottom lid (12) is set on and closes the opening (13) of the shell (11), so that the interior of the shell (11) is a closed space (14), and the closed space (14) is filled with a flowable liquid. The liquid may contain sequins or glitter particles (not shown) mixed therein in order to enhance a sense of glittering of the aqueous sphere (1). Further, the shell (11) has a top that is provided with a positioning groove (15) that is formed, through recessing, in an inside surface thereof.

The magnetic moving member (2) is arranged in the closed space (14), and is located on the bottom lid (12) at the bottom of the aqueous sphere (1). The bottom lid (12) is formed, through recessing, with a constraint cavity (16), and the magnetic moving member (2) is rotatable, as being attracted, within a range of the constraint cavity (16). In the instant embodiment, the magnetic moving member (2) has a bottom that is spherical in shape and a top that includes a flat surface and a plurality of vanes (21) that is arranged in a radiating form on the flat surface for driving the liquid to move.

The fixed decoration piece (6) has a bottom formed as a positioning seat (3) and is arranged in the closed space (14) and located on the bottom lid (12). In the instant embodiment, the fixed decoration piece (6) and the positioning seat (3) are integrally formed together and extending from each other. The positioning seat (3) is light-transmitting and is formed with a notch (33) in a direction facing downward and thus defines an inverted U-shape. The magnetic moving member (2) is arranged in the notch (33), so that the positioning seat (3) constrains the magnetic moving member (2) to rotate within e in a given range. The fixed decoration piece (6), as an example shown in the drawings, is shaped as a bird, but is not limited thereto. Other shapes, including geometric shapes, such as circle, square, and polygon, may be taken as a basis for further modifying and expanding to exhibit any imagable shape, such as animal, plant, figure, and so on. This enriches visual perception of a user and enhance product uniqueness, to thereby improve competition power of a product.

The suspending decoration piece (4) includes a bottom plate (41) and a first decoration plate (42). The bottom plate (41) has a top that is raised up to form a fitting segment (43) protruding therefrom. The bottom plate (41) is formed with a through hole (44) in an axial direction. The through hole (44) has a circumference that is provided with a plurality of rotating parts (45) arranged at intervals and spaced from each other. The first decoration plate (42) includes two shaped braces (421) that are symmetric with respect to each other. The two shaped braces (421) are connected to each other at one end to exhibit a shape of an arch and are each provided, in an opposite end, with a fitting groove (G), such that the fitting grooves (G) of the shaped braces (421) are fit onto and thus fixed to the fitting segment (43) of the bottom plate (41). The first decoration plate (42) has a top that is provided with a positioning projection (422). The suspending decoration piece (4) is supported by in the liquid, such that the positioning projection (422) is received into and abutting the positioning groove (15) of the shell (11), while the bottom plate (41) is in a suspending condition to define a distance (H) with respect to the bottom lid (12).

The base (5) is connected to the bottom of the aqueous sphere (1). The base (5) is provided, in an interior thereof, with an electric control unit (51), which mainly comprises a control circuit board (511), a switch (512), and at least one light-emitting element (513). The light-emitting element (513) and the switch (512) are each electrically connected with the control circuit board (511), and the light-emitting element (513) illuminates in a direction toward the aqueous sphere (1). Electric power of the electric control unit (51) can be supplied from an electric main or a battery. Further, the present invention imposes no limitation to the type of the light-emitting element (513), which can be, for example, a light bulb or a light-emitting diode (LED). Further, the base (5) is provided, in the interior thereof, with a magnetic rotary axle (52) that corresponds to and is set in magnetic attraction with respect to the magnetic moving member (2). The magnetic rotary axle (52) is driven by a power member (53) to rotate, and the present invention does not limit the type of the power member, of which a preferred example is an electric motor.

As such, when the electric control unit (51) is supplied with electricity and thus electrically activated, the magnetic rotary axle (52) is driven by the power member (53) to rotate, and the magnetic moving member (2) is attracted thereby to rotate in unison therewith to disturb and drive the liquid contained in the closed space (14) to flow in a circumferential direction, so that the suspending decoration piece (4) that is in a suspending condition is driven by the water flow to rotate relative to the fixed decoration piece (6) that is mounted on the bottom lid (12) to thereby provide a dynamic visual perception.

It is noted that the suspending decoration piece (4) is set in a floating condition as being supported by buoyance of the liquid, and, in this invention, the positioning projection (422) at the top of the first decoration plate (42) that is received in and abutting the positioning groove (15) limits a floating range of the suspending decoration piece (4) in an axial direction, keeping it in a range of verticality during the rotation thereof, without being caused to incline by the flow of the liquid. Further, when the electric control unit (51) is supplied with electricity, the light-emitting element (513) generates light that transmits through the bottom lid (12) of the aqueous sphere (1), such that refraction caused by the liquid results in variation of shade cast by the light to thereby more effectively improve the overall visual perception provided by the present invention.

Further referring to FIGS. 4-7, another embodiment of the fixed decoration piece (6) according to the present invention is provided. In the instant embodiment, the positioning seat (3) includes two circumferential ribs (31) that are spaced from each other in a vertical direction and a plurality of plates (32) that are connected to each of the circumferential ribs (31) and are arranged at intervals and thus spaced from each other, with some of the plates (32) being connected to the bottom lid (12) and thus fixed, to surround and enclose the magnetic moving member (2) therein. The fixed decoration piece (6) is provided with at least one trough (G1) formed in the bottom thereof. The fixed decoration piece (6) is fit, in a detachable manner, to and thus mounted to the circumferential ribs (31) of the positioning seat (3) by means of the trough (G1).

Figure 8:
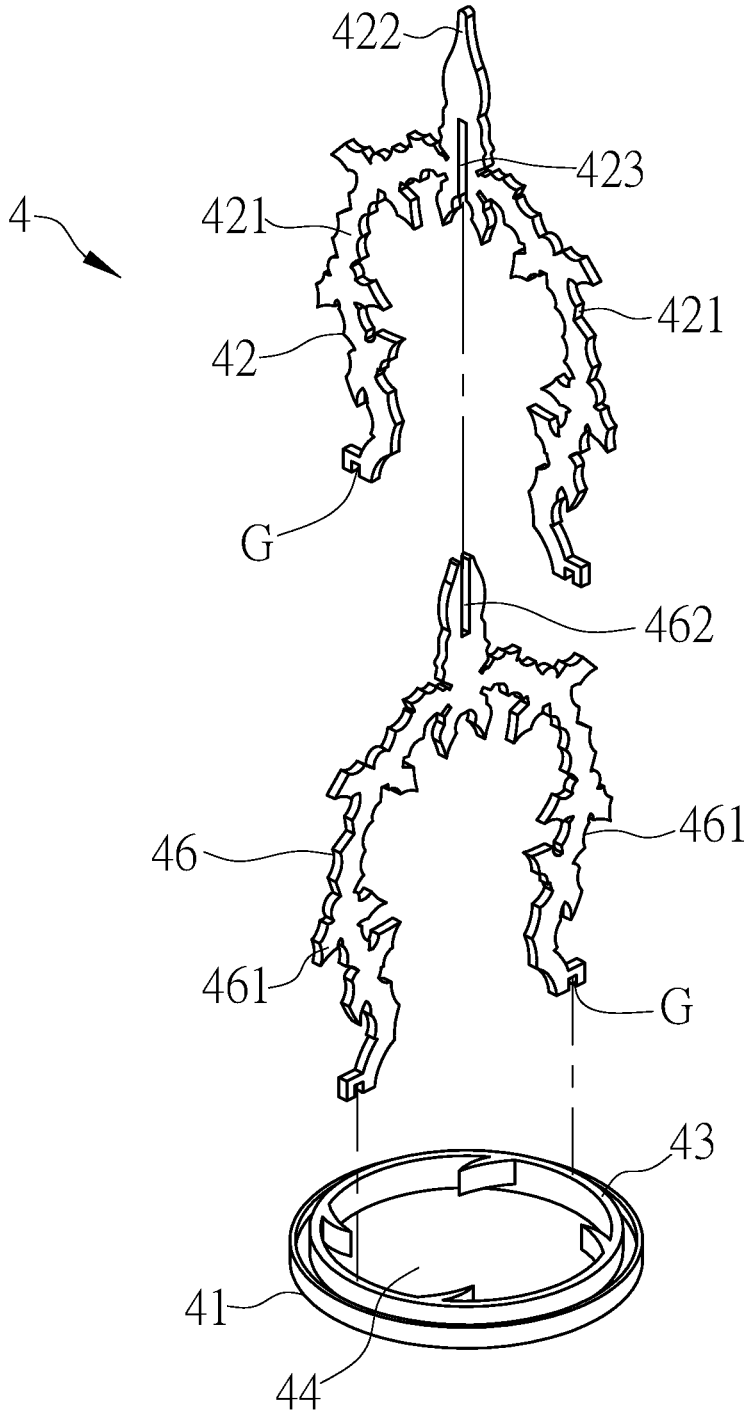
FIG. 8 is an exploded view illustrating a suspending decoration piece according to a further embodiment of the present invention.
Figure 9:
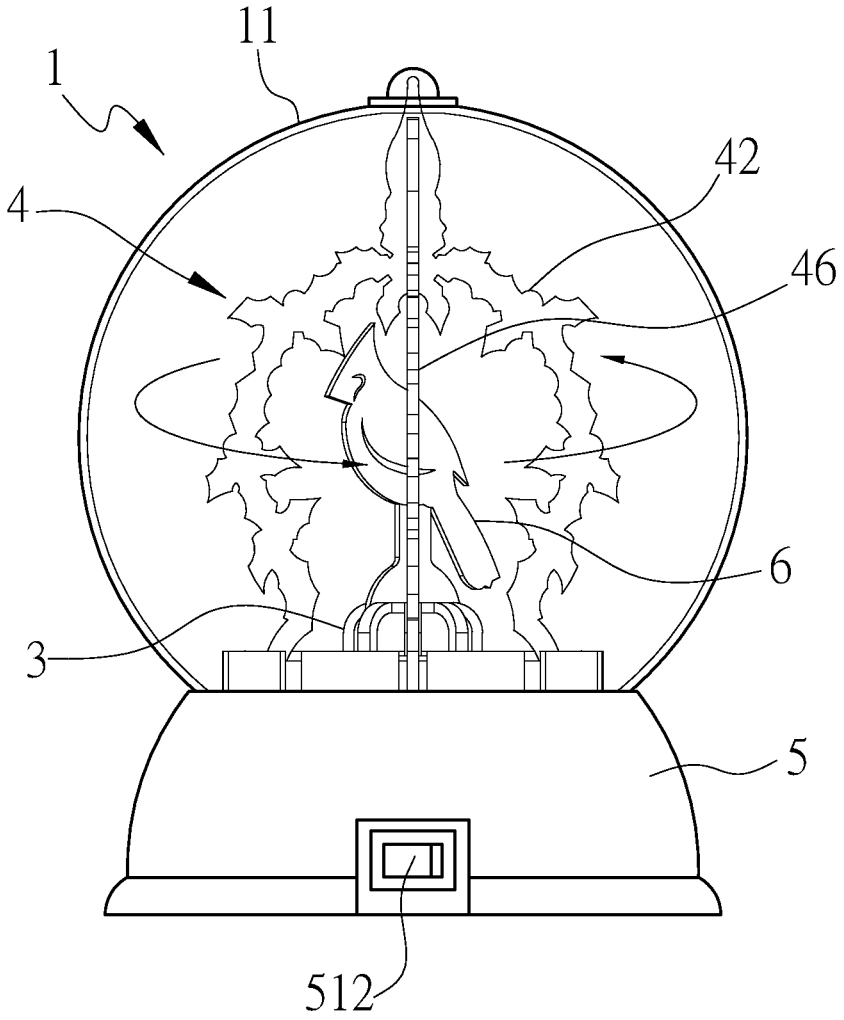
FIG. 9 is a schematic view illustrating the present invention in a plan form.

Further referring to FIGS. 8 and 9, another embodiment of the suspending decoration piece (4) according to the present invention is shown. The instant embodiment is different from the structures described above in that the first decoration plate (42) is formed, in the connection between the two shaped braces (421) thereof, with a first slit (423) having an opening facing downward, and the suspending decoration piece (4) further comprises a second decoration plate (46), which includes two shaped braces (461) that are symmetric with respect to each other. The two shaped braces (461) are connected to each other at one end to exhibit a shape of an arch, and a second slit (462) is formed in the connection and has an opening facing upward. The second slit (462) is fit into and set in inter-fitting engagement with the first slit (423). The two shaped braces (461) are each provided, in an opposite end thereof, with a fitting groove (G) for being fit onto and thus fixed to the fitting segment (43), so that the first decoration plate (42) and the second decoration plate (46) are set in a mutually crossing configuration.

The suspending decoration piece (4) is thus set in a mutually crossing configuration of arches by having the first decoration plate (42) and the second decoration plate (46) mutually inserted into each other and is allowed to rotate about the fixed decoration piece (4) to thereby improve the effect of dynamic visual perception.

I claim:

1. A rotating lighting decoration, mainly comprising:

an aqueous sphere, which is of a light-transmitting three-dimensional configuration and includes a hollow shell and a bottom lid, the shell being formed with an opening facing down, the bottom lid being set on and closing the opening of the shell so as to define a closed space in an interior of the shell, the closed space being filled with a flowable liquid;

a magnetic moving member, which is arranged in the closed space and is located at a bottom of the aqueous sphere;

a fixed decoration piece, which is arranged in the closed space and disposed on the bottom lid and has a predetermined shape, the fixed decoration piece having a bottom that is provided with a positioning seat, by which the magnetic moving member is constrained to rotate in a given range;

a suspending decoration piece, which includes a bottom plate and a first decoration plate, the bottom plate being formed, in an axial direction, with a through hole, the through hole having a circumference that is provided with a plurality of rotating parts spaced from each other, the first decoration plate including two shaped braces that are symmetric, the two shaped braces being connected to each other at one end and each having an opposite end disposed on the bottom plate, the suspending decoration piece being supported by the liquid, so as to have a top thereof abutting the shell and a bottom set in a suspending condition to define a distance from the bottom lid; and a base, which is connected to the bottom of the aqueous sphere, the base including an electric control unit, the electric control unit comprising at least one light-emitting element, the light-emitting element being electrically connected with the electric control unit, the light-emitting element being operable to illuminate in a direction toward the aqueous sphere, the base including a magnetic rotary axle that corresponds to and attracts the magnetic moving member, the magnetic rotary axle being drivable by a power member to rotate;

wherein when the magnetic rotary axle is rotating, the magnetic moving member is attracted thereby to rotate in unison therewith to disturb and drive the liquid to flow in the interior, so as to cause the suspending decoration piece to move with the flow of the liquid for rotating relative to the fixed decoration piece.

2. The rotating lighting decoration according to claim 1, wherein the bottom plate of the suspending decoration piece includes a fitting segment raised therefrom, each of the shaped braces being formed with a fitting groove, which is fit onto and mounted to the fitting segment, the connection of the shaped braces being formed with a first slit having an opening facing downward, the suspending decoration piece further comprising a second decoration plate, which includes two shaped braces that are symmetric, the two shaped braces being connected to each other at one end, the connection being formed with a second slit having an opening facing upward, the second slit being fit into the first slit, the two shaped braces each having an opposite end that is formed with a fitting groove, which is fit onto and mounted to the fitting segment.

3. The rotating lighting decoration according to claim 1, wherein the shell has an inside surface that is recessed to form a positioning groove, and the first decoration plate is provided, on a top thereof, with a positioning projection corresponding to the positioning groove.

4. The rotating lighting decoration according to claim 1, wherein the positioning seat of the fixed decoration piece is formed with a notch facing downward, the magnetic moving member being disposed in the notch.

5. The rotating lighting decoration according to claim 1, wherein the positioning seat includes two circumferential ribs that are spaced from each other in a vertical direction and a plurality of plates connected to each of the circumferential ribs and arranged to space from each other, the fixed decoration piece having a bottom that is formed with at least one trough, the fixed decoration piece being detachably mounted to the positing seat by the trough.

6. The rotating lighting decoration according to claim 1, wherein the magnetic moving member has a top that is provided with vanes arranged in a radiating fashion.

7. The rotating lighting decoration according to claim 1, wherein the base comprises a switch, which is electrically connected with the electric control unit.

8. The rotating lighting decoration according to claim 1, wherein the light-emitting element comprises a light-emitting diode (LED).

* * * * *